United States Patent [19]

Hasegawa

[11] 4,262,716

[45] Apr. 21, 1981

[54] VENEER LATHE

[75] Inventor: Katsuji Hasegawa, Ohbu, Japan

[73] Assignee: Meinan Machinery Works, Inc., Ohbu, Japan

[21] Appl. No.: 11,548

[22] Filed: Feb. 12, 1979

[30] Foreign Application Priority Data

Feb. 19, 1978 [JP] Japan ..... 53/18324

[51] Int. Cl.[3] ..... B27L 5/02

[52] U.S. Cl. ..... 144/213; 144/209 R

[58] Field of Search ..... 144/209–215, 144/323, 325, 321

[56] References Cited

U.S. PATENT DOCUMENTS

| | | | |
|---|---|---|---|
| 1,641,452 | 9/1927 | Osgood | 144/209 R X |
| 1,877,013 | 9/1932 | Moore | 144/209 R |
| 3,207,194 | 9/1965 | Hedberg et al. | 144/213 |
| 3,349,820 | 10/1967 | Nagaoka | 144/209 |
| 3,480,053 | 11/1969 | Whipple | 144/213 |
| 4,061,169 | 12/1977 | Hasegawa | 144/209 R |

FOREIGN PATENT DOCUMENTS

| | | | |
|---|---|---|---|
| 2755097 | 7/1978 | Fed. Rep. of Germany | 144/213 |

*Primary Examiner*—W. Donald Bray

*Attorney, Agent, or Firm*—Lackenbach, Lilling & Siegel

[57] ABSTRACT

A veneer lathe in which a log is rotatably supported, and powered endless chain members having sharpened projections on their outer side are employed to rotatably drive the log. A knife is provided at the log surface so that the log is cut in a circumferential direction as the knife moves toward the longitudinal axis of the log and the log rotates. Log pressure means are provided to press the log surface adjacent the knife edge, and a conventional transport mechanism moves the assembly of the endless chain members, the knife, and the log pressure means toward the longitudinal axis of the log in synchronization with the log rotation so that a veneer is continuously cut from the log.

9 Claims, 14 Drawing Figures

VENEER LATHE

BACKGROUND OF THE INVENTION

This invention relates to a veneer lathe in which a log is rotated around its longitudinal axis, and a knife contacts the log surface while the log surface adjacent the knife edge is pressed by a pressure member.

According to the prior art for this type of veneer lathe, a log is rotated by a chuck, and a force against the cutting resistance and friction which is due to the pressure member contacting the log surface, is transmitted from the chuck to the cutting surface through the log itself.

This type of veneer lathe has the following drawbacks: First, the veneer lathe cannot be used for logs having a hard structure or for logs soft core section, and including cracks and spoiled sections. This is due to the possibility of the log breaking especially at the core section, and allowing the chuck to freely run, since a large force is applied to the small radius section for transmitting the torque against the cutting resistance at the log surface. Generally, tropical woods, which are now widely used to produce veneer, have a soft core section.

To make matters worse, the log is pressed longitudinally at the chuck so as to ensure the transmission of the torque. The radius of the chuck must be made small in order to cut as much of the log as possible for improved productivity. However, if the chuck is made too small, the risk of breaking the log increases, and thus productivity is limited. Second, wood pieces removed from the log surface often jam between the log and the knife, between the log and the pressure member, and between the knife and the pressure member. Veneer sheets produced under the jam condition are too inferior to be further processed, so consequently material is wasted. Also, when a jam occurs, the log revolving speed must be reduced and often must be stopped completely. This reduces productivity. Furthermore, when a jam occurs, the load increases, frequently resulting in breakage of the log core.

In order to solve these problems, an improved veneer lathe has been disclosed by the same applicant in U.S. patent application Ser. No. 861,278. The veneer lathe proposed in the application is characterized in that drive rollers having sharpened projections on the surface are provided adjacent the knife edge to rotatably drive a log at its circumference, instead of applying the revolving force to the log only through the chuck. In this method, the driving force is applied on the log surface close to the knife edge at several places extending in the longitudinal direction, preventing breakage of the core at the chuck. At the same time, jammed wood pieces can be removed by the driving action of the drive roller.

However, this method has some drawbacks: First, an entire drive roller must be replaced when projections on its surface are broken. Second, the drive rollers thrust the projections on the log surface, and the pressing force against the log when the log diameter becomes small, makes the cutting operation very difficult.

SUMMARY OF THE INVENTION

To solve these new problems, there is provided a veneer lathe which essentially comprises a log holding means which rotatably supports a log at both axial ends; a tangential knife adapted to contact the log surface and cut the log to produce the veneer as the log rotates; a plurality of endless chain members provided along the log at spaced intervals, a portion of each endless chain member running along the log surface closely ahead of the edges of the knife; a chain drive motor which drives the endless chain members; a plurality of sharpened projections arranged on the outer side of the endless chain members; pressure wheels bearing against the endless chain members, thrusting the sharpened projections on the log surface; a plurality of log pressure means arranged between the endless chain members closely ahead of the edge of the knife to press the log surface; and a transport mechanism which moves the assembly of the knife, endless chain members, pressure wheels, and log pressure means toward the log center correspondingly to the rotation of the log; said transport mechanism being a means well known and conventionally used in the art in order to carry out the cutting operation. The veneer is thus continuously cut from the log as the log diameter decreases.

BRIEF DESCRIPTION OF THE DRAWINGS

The invention will now be described by way of example with reference to the accompanying drawings in which.

DETAILED DESCRIPTION OF THE PREFERRED OF THE INVENTION

Figure 1:
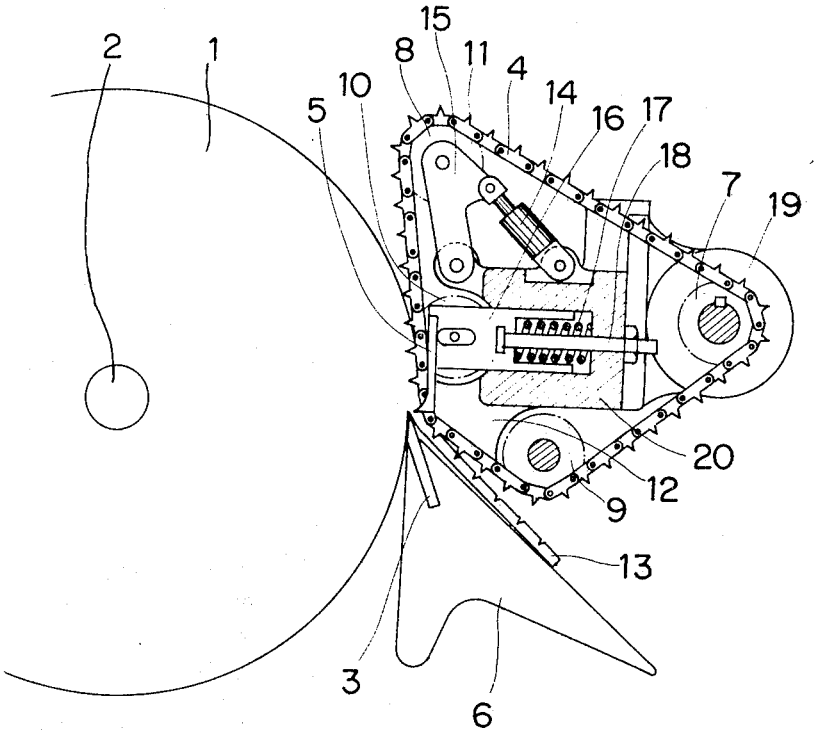
FIG. 1 is a sectional view of a veneer lathe embodying the invention.
Figure 2:
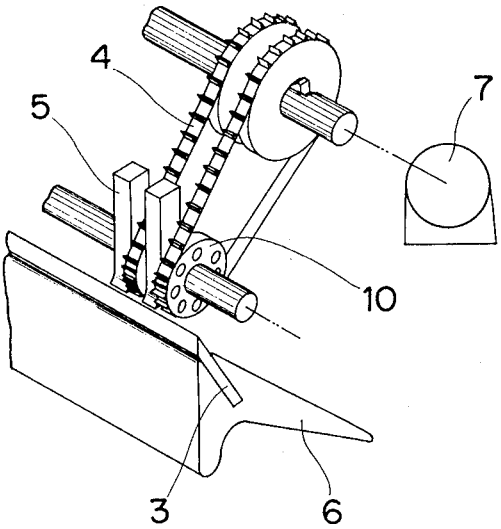
FIG. 2 is a perspective view of a veneer lathe with a different arrangement of chain members.

Referring to FIG. 1, log 1 is rotatably supported by log holder 2 at both ends, and a knife 3 is fixed on knife holder 6. Above the knife 3, there are provided a plurality of endless chain members 4 in spaced intervals along the longitudinal axis of log 1. Between each endless chain member 4 there are provided several pressure bars 5, as best shown in FIG. 2. Each pressure bar 5 presses log 1 closely above the knife edge. Returning to FIG. 1, each endless chain member 4 is trained on a drive spocket wheel 7 connected to an electric motor 19, guide sprocket wheels 8 and 9, and a pressure wheel 10 which thrusts the spikes 11 provided on endless chain member 4 into the log surface. Guide plate 12 is provided between each pressure wheel 10 and each guide sprocket wheel 9, so that as the chain member 4 runs, spikes 11 are thrust into both the log surface and the veneer. Hydraulic cylinder 14 and swing arm 15 are provided for each endless chain member 4 in order to provide a proper tension thereto. Each pressure bar 5 is fixed on bracket a 16, which is pressed by spring means 17 toward the log 1. The position of bracket 16 is adjusted by adjusting bar 18 with a stop nut which contacts base 20 by the action of the spring means 17. Each pressure bar 5 is arranged so that its tip presses the log surface closely above the knife edge. The shaft of each pressure wheel 10 is attached on the base 20 through a long hole on bracket 16 so that said bracket can move independently of the pressure wheel.

A veneer lathe constructed as explained above operates as follows. Several endless chain members 4 are powered by an electric motor 19, while spikes on the endless chain members 4 are thrust into the surface of the log 1, and the log 1 is thus rotated. As log 1 rotates, knife 3 cuts the log in a circumferential direction, producing the veneer 13.

By this cutting method, the core section of the log can substantially be free from the cutting force, and even a log having a soft core section can be used efficiently to produce the veneer. Log 1 is pressed by pressure bars 5, so the texture of the veneer does not become rough when veneer 13 is cut from the log by knife 3, and a high quality veneer can be produced. Additionally, many cracks are formed on the veneer by spikes 11 of the endless chain members 4, and these cracks soften the veneer to help make it pliant and make the post cutting processing easy. Furthermore, if small wood pieces removed from a defective portion of the log jam between pressure bar 5 and log 1, they are ejected by the driving action of spikes 11 on endless chain members 4. Thus, jamming of wood pieces at the cutting section of the veneer lathe can be avoided.

Figure 3:
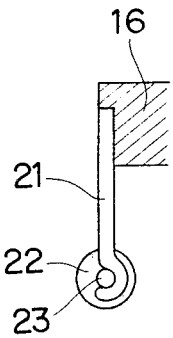
FIG. 3 is a sectional view of another embodiment of a log pressure member.

Another advantage of the veneer lathe according to the present invention can be shown in comparison with a veneer lathe disclosed by the same applicant in U.S. Pat. application Ser. No. 861,278, where the log surface is driven to rotate by means of rollers having spikes on their surface. In the case of the veneer lathe in the above application, all of the spikes act to apply both the revolving force and pressing force to the log. According to the present invention, spikes 11 on endless chain members 4, once they have been thrust into the log surface by pressure wheel 10, act to apply only revolving force to the log. Thus, bending of the log is reduced, and the accuracy and quality of the veneer can be improved. Elastically supported pressure bar 5 in that embodiment of the invention has an advantage in that log breakage can be avoided when the tip of a pressure bar is caught by a very hard portion of the log surface such as a node. Another kind of log pressure member as shown in FIG. 3 may be used, where one end of spring bar 21 is attached to a bracket 16 and a roller 22 is rotatably attached to the other end of the spring bar 21 through a pin 23.

Figure 4:
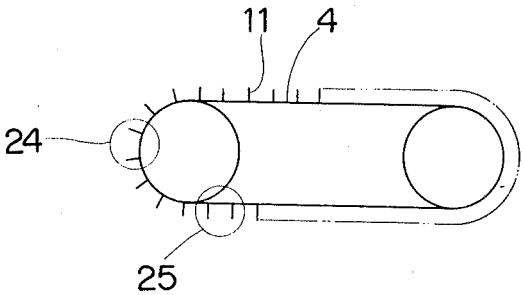
FIG. 4 is a schematic illustration of an endless chain member and the projections on it.
Figure 5:
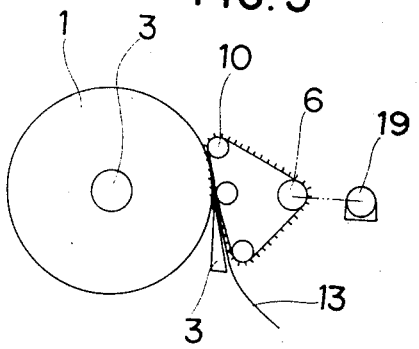
FIG. 5 and FIG. 9 are schematic illustrations of a veneer lathe with different chain arrangements.
Figure 6:
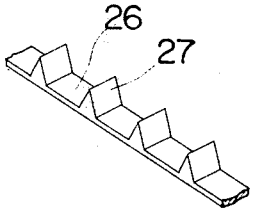
FIG. 6 and FIG. 7 are perspective views of different embodiments of the endless chain member.
Figure 7:
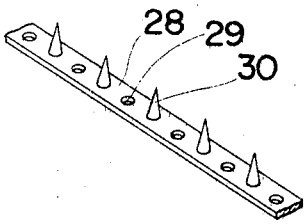

It is known that veneer without cracks on the core side surface can be produced when the veneer is pressed against its moving direction immediately after it has been cut from the log. It is also known that when the log is cut under a pulling force toward the turning direction, the crack made by the knife edge advances toward the surface of the log, making the texture of the veneer very fine. According to the present invention, either said pressing force or the pulling force can be applied on the veneer immediately after it has been cut from the log, by means of endless chain members 4. As shown in FIG. 4, the distance between each spike 11 at the tip when the spikes are in the circular arc range 24 of endless chain member 4 is larger than that in the linear range 25. Therefore, at the place where spikes move from the linear range to circular arc range with the chain member, the pulling force is applied on the veneer. In the chain arrangement shown in FIG. 1, the spikes approach the log in the linear range, and leave the cutting section in the circular arc range. Thus, such pulling force acts on the veneer when it has been cut from the log. In another example of the chain arrangement as schematically shown in FIG. 5, the spikes on each chain member are thrust into log 1 by the pressure wheel 10 when they are in the circular arc range, and later, the spikes move in the substantially linear range on the log surface and the veneer 13. Thus, the log is cut under the pressing force applied to the veneer against its moving direction immediately after it has been cut from the log. Although endless chain members are disclosed in the above embodiment, it is also possible to use endless metal belts 26 as shown in FIG. 6, on which knife edges 27 are formed, or an endless metal belt 28, on which holes 29 are made between each cone-shaped projection 30 formed on said metal belt in order to ensure the driving of the log. In the above embodiment as explained with FIG. 1, spikes 11 on endless chain members 4 are thrust into both the log surface and the veneer. However, if the effect of thrusting spikes onto veneer is not required, the endless chains may be arranged so that the spikes on the endless chain members are only thrust into the log surface.

Figure 8:
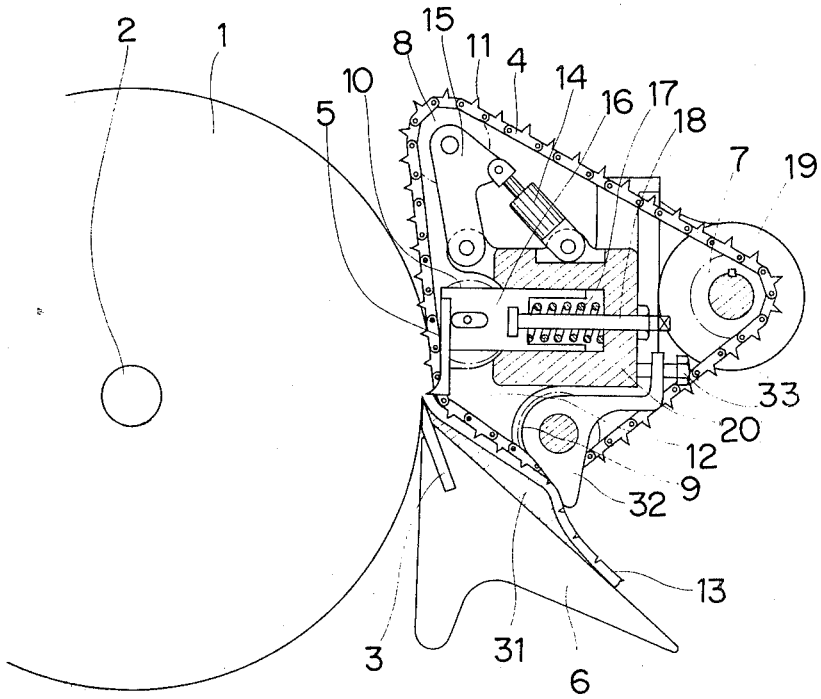
FIG. 8 is a sectional view of a veneer lathe having veneer guides.
Figure 9:
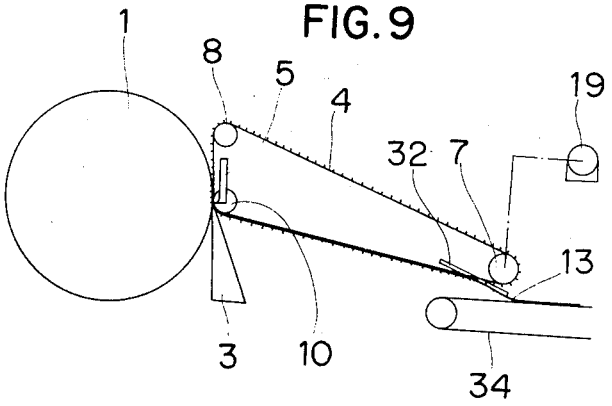

Next, an illustration will be given with respect to the second embodiment in which the veneer lathe is additionally provided with a veneer guide. As shown in FIG. 8, a knife holder 6 carries first veneer guide 31 thereon which faces the core side of the veneer 13. On the other side of said veneer 13, second veneer guides 32 are arranged each between two adjacent chain members 4. Said second guides are adjustably screwed onto the base 20 by adjusting bolts 33. The guide face of each second veneer guide is designed to extend above and below the chain member, that is from the base side to the veneer side. It is preferable to design the end portion of the guide surface of second guide 32 such that veneer 13 is bent as depicted in order to avoid possible curve of the veneer. This structure is intended to positively release veneer 13 from engagement with the spikes of of the chain member by forcibly changing the direction of the veneer movement. Further, the second guide 32 may be disposed such that each guide surface has a relatively large angle with respect to the chain member. In this modification, the veneer is bent opposite to the direction of its curling, thus relizing a preferable tenderizing effect. Further, as shown in FIG. 9, in the arrangement of chain members 4 trained around a drive sprocket wheel, guide sprocket wheel 8 and pressure wheel 10 with appropriate spacings, and conveyor 34 provided below drive sprocket wheel 7, the second veneer guide 32 may be disposed above the conveyor such that the released veneer will be fed to the next process.

Figure 10:
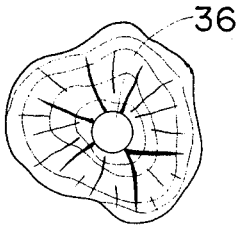
FIG. 10 is a sectional view of a log.
Figure 11:
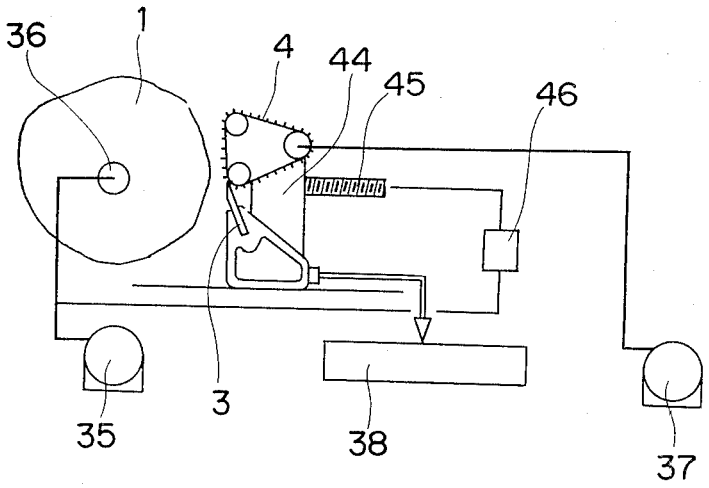
FIG. 11 through FIG. 14 are schematic illustrations of power sources of a veneer lathe.
Figure 12:
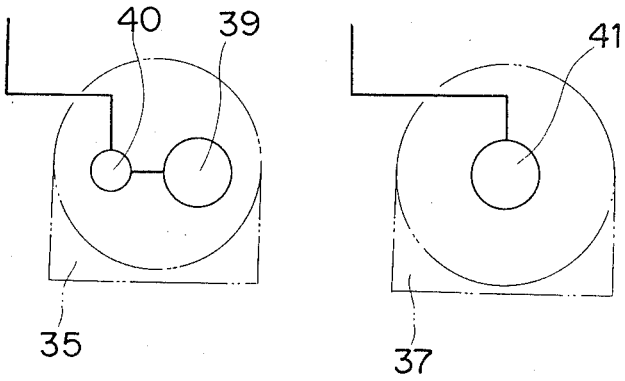
Figure 13:
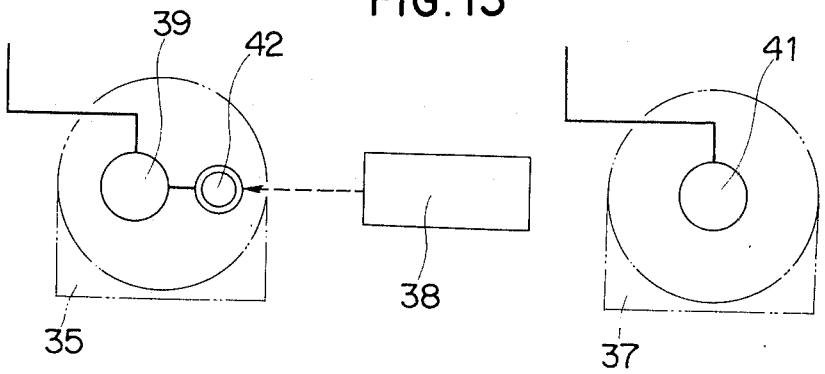
Figure 14:
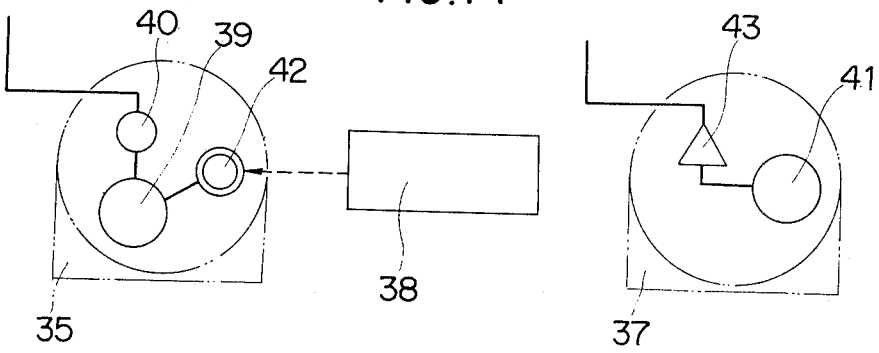

Further embodiments having a spindle drive mechanism will now be explained. Because other sections of the veneer lathe are constructed equal to those of the first or second embodiment, only the spindle drive mechanism will be explained. Referring to FIG. 11, there is shown a spindle drive mechanism 35 which drives cutter assembly 44 through gear box 46 and lead screw 45, and spindle 36, and chain drive mechanism 37 which drive endless chain member 4, and knife position detector 38. FIG. 12 shows one example of the spindle drive mechanism and the chain drive mechanism, in which an electric motor 39 and torque limiter 40 are provided in spindle drive mechanism 35, so that a limited revolving force is applied to the log through the spindle in addition to the force generated by electric motor 41 in the chain drive mechanism 37, when the log is cut. Said spindle drive mechanism is also used to rotate the log under free load condition when the sectional profile of the log is largely deviated from the circle as shown in FIG. 10 and driving chain members do not reach the concave section of the log surface. For torque limiter 40, many mechanical and electrical devices, such as the electromagnetic clutch, are available. Such torque limiter may be equipped in chain drive mechanism 37, or also may be equiped in both the spindle drive mechanism 35 and the chain drive mechanism 37. FIG. 13 shows another example of the spindle drive mechanism and the chain drive mechanism, in which a speed control mechanism 42 is provided to control the revolving speed of the electric motor 39 in accordance with the signal generated in the knife position detector 38, so that peripheral velocity of the log is substantially identical to the running speed of the chain members. Said revolving speed control may be performed at the chain drive mechanism 37 to control the chain speed, or may be performed at both the spindle drive mechanism 35 and the chain drive mechanism 37. FIG. 14 shows a further example of the spindle the spindle drive mechanism and the chain drive mechanism, in which the spindle drive mechanism 35 comprises electric motor 39, speed control mechanism 42 and torque limiter 40, and the chain drive mechanism 37 comprises electric motor 41 and overrunning mechanism 43. Said speed control mechanism 42 controls the revolving speed of motor 39 in accordance with the signal generated by the knife position detector 38, so that the log is revolved at a larger peripheral velocity than the chain speed when the log is in the free load condition. When the log surface contacts with the knife, the log is cut initially by the kinetic energy of the log and by the force supplied from the spindle drive mechanism 35. However, the revolving speed of the log slows down since the torque of the spindle drive mechanism is limited by a torque limiter 40. When the peripheral velocity of the log becomes slower than the chain speed, the chain drive mechanism turns to supply the major part of the revolving force to the log, thus the cutting force is uniformly applied to the log even for an unevenly shaped log.

Although the present invention has been described in some detail by way of illustration and example for purposes of clarity of understanding, it will, of course, be understood that various changes and modifications may be made in the form, details and arrangements of the parts without departing from the scope of the invention as set forth in the following claims.

What is claimed is:

1. A veneer lathe comprising a log holding means which rotatably supports a log at its ends;

a tangential knife having a knife edge adapted to contact the log surface and cut the log to peel off veneer as the log rotates;

a plurality of endless chain members provided along the log at spaced intervals, a portion of each endless chain member contacting and moving the log closely ahead of the knife edge;

a chain drive motor for driving said endless chain members;

a plurality of projections on the outer side of said endless chain members for applying a revolving force to said log once said projections have been thrust into the log surface;

pressure wheels bearing against the inner side of said endless chain members, thrusting said projections into the log surface;

a plurality of log pressure means, each having an adjusting bar, arranged between said endless chain members closely ahead of the knife edge to press the log surface; and a transport mechanism for moving the assembly of said knife, endless chain members, pressure wheels, and said log pressure means toward the log correspondingly to the rotation of the log.

2. A veneer lathe as claimed in claim 1, wherein said endless chain members are arranged so that said projections thrust both into the log surface and the veneer.

3. A veneer lathe as claimed in claim 1 or claim 2, wherein a first veneer guide is provided on the downstream side of the knife edge facing the core side of the veneer and second veneer guides are provided between said chain members such that their guide faces or surfaces extend above and below the chain members to remove said veneer from said chain members by changing the direction of veneer movement.

4. A veneer lathe as claimed in claim 1 or claim 2, wherein said log holder means is powered by a log revolving motor to rotate the log.

5. A veneer lathe as claimed in claim 4, wherein said log revolving motor has a smaller output torque than that required to cut the log.

6. A veneer lathe as claimed in claim 5, wherein said chain drive motor is provided with an overrunning mechanism such that said endless chain members can run freely when the peripheral speed of the log is faster than the running speed of the endless chain members driven by the said chain drive motor.

7. A veneer lathe as claimed in claim 1, wherein said endless chain members comprise endless metal belts having a plurality of projections.

8. A veneer lathe as claimed in claim 7, wherein said projections are sharp and pointed.

9. A veneer lathe as claimed in claim 7, wherein said projections are in the form of knife edges.

* * * * *